United States Patent [19]

Robins et al.

[11] Patent Number: 4,457,548

[45] Date of Patent: Jul. 3, 1984

[54] ASH AND DEBRIS SCOOP

[76] Inventors: Ivan L. Robins, Box 124, Scipio, Utah 84656; Lavoy Starley, 290 N. 300 W., Fillmore, Utah 84631

[21] Appl. No.: 369,268

[22] Filed: Apr. 16, 1982

[51] Int. Cl.[3] ..... A47F 13/08

[52] U.S. Cl. ..... 294/55; 294/9

[58] Field of Search ..... 294/55, 9, 10, 50.9, 294/53.5, 49, 50.8; 15/257.1, 257.2, 257.5, 257.6

[56] References Cited

U.S. PATENT DOCUMENTS

| | | | |
|---|---|---|---|
| 1,410,369 | 3/1922 | Chagnon | 294/55 |
| 1,474,634 | 11/1923 | Johanns | 294/55 |
| 3,026,138 | 3/1962 | Bejamin et al. | 294/55 |

*Primary Examiner*—James B. Marbert

*Attorney, Agent, or Firm*—Thorpe, North & Western

[57] ABSTRACT

A scoop for ashes and debris includes a receptacle, open at one end and having a generally flat bottom wall. A door is attached by hinge to the top of the opening in the receptacle to move between a closed position, where the door covers the opening, and an open position, where the door is swung upwardly and away from the opening. A spring located exteriorly of the receptacle biases the door normally to the open position. An elongate pull rod is attached at one end to the underside of the door to extend through the receptacle and through a rear wall thereof. The portion of the pull rod extending through the rear wall is formed into a grasping element for grasping by hand to enable pulling the rod rearwardly to thus pull the door to the closed position. A handle extends from near the opening in the receptacle upwardly, rearwardly, and then downwardly to a point on the rear wall below the grasping element.

7 Claims, 3 Drawing Figures

ASH AND DEBRIS SCOOP

BACKGROUND OF THE INVENTION

The present invention relates to an ash and debris scoop which may be used and manipulated with one hand to remove ashes from a fireplace or the like.

A number of implements have been proposed for use in removing ashes from fireplaces, stoves and the like. See, for example, Joseph F. Kalam, U.S. Pat. No. 4,299,419, Carl E. Rogalski, U.S. Pat. No. 4,214,784, H. L. Peebles, U.S. Pat. No. 1,762,347, and H. N. Johanns, U.S. Pat. No. 1,474,634. These implements are primarily concerned with preventing the escape of ash and ash dust after the ash has been scooped into the implement and, although they appear to achieve this objective, the implements are generally complex in construction and cumbersome to use.

SUMMARY OF THE INVENTION

It is an object of the invention to provide an ash and debris scoop which is simple in design and construction.

it is another object of the invention to provide such a scoop which may be economically manufactured.

It is an additional object of the invention to provide an ash and debris scoop in which the various parts are positioned so as to reduce the likelihood of structural fatigue or failure.

It is a further object of the invention to provide such a scoop which may be operated by using only one hand.

The above and other objects of the invention are realized in a specific illustrative embodiment of an ash and debris scoop which includes a receptacle having a generally flat bottom wall, side walls, a rear wall, and a top wall, with the receptacle being open at one end. A door is hingedly attached to the forward edge of the top wall for pivoting between a closed position, in which the door covers the opening in the receptacle, and an open position, in which the door is pivoted upwardly and away from the opening. A biasing element is included to bias the door normally to the open position. An elongate pull rod is mounted in the receptacle with one end pivotally attached to the underside of the door, with the rod extending from the door through the receptacle and through an opening in the rear wall thereof. The other end of the rod exterior to the receptacle is formed into a grasping element for grasping by hand to enable pulling the rod rearwardly to thus pull the door to the closed position. A handle extends from a point generally near the forward edge of the top wall upwardly, rearwardly, and downwardly to a point on the rear wall below the grasping element. A rear portion of the handle is spaced behind the grasping element to enable grasping and pulling the grasping element while also holding the rear portion of the handle. With this construction, use and operation of the scoop with only one hand is possible.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
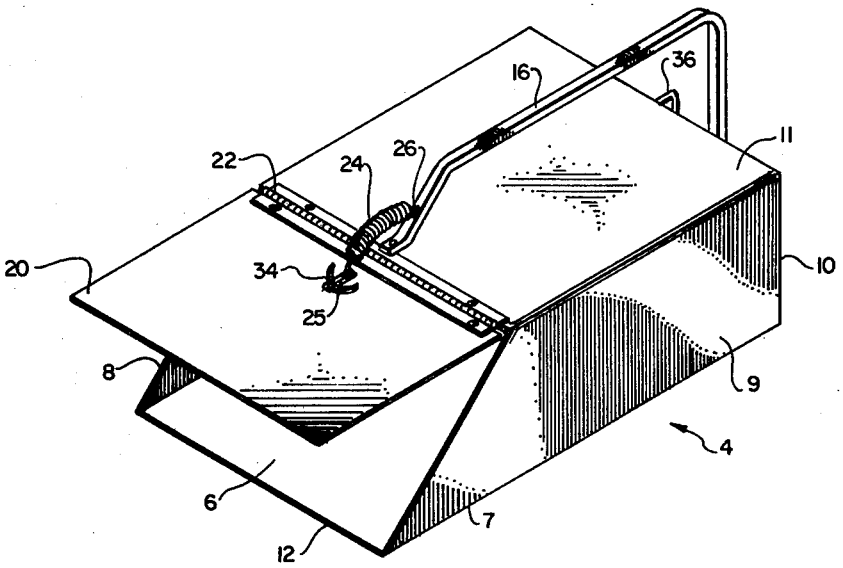
FIG. 1 shows a perspective view of an ash and debris scoop made in accordance with the principles of the present invention.
Figure 2:
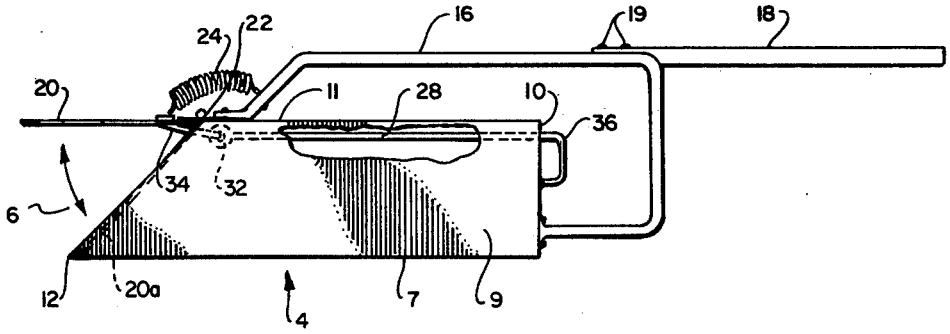
FIG. 2 shows a side, elevational, partially cut-away view of the scoop of FIG. 1, with the additional feature of an extension handle.

Referring to FIGS. 1 and 2, there is shown a specific illustrative embodiment of the present invention. This embodiment includes a generally rectangle housing or receptacle 4 having an opening 6 at one end thereof. The receptacle is formed with a generally flat bottom wall 7, two side walls 8 and 9 which extend upwardly from each side of the bottom wall, a rear wall 10 which extends upwardly from the back edge of the bottom wall, and a top wall 11 which joins the upper edges of the two side walls 8 and 9 and the rear wall 10. The forward edge 12 of the bottom wall projects outwardly further than the forward edge of the top wall, as generally shown in the drawings, to facilitate the shoveling or scooping of ashes or other debris into the interior of the receptacle 4. The receptacle could be constructed of a variety of materials, with mild sheet steel being a preferred material.

A handle 16 is fitted to extend over the top and back of the receptacle 4. In particular, the handle 16, which may be of tubular, bar, etc. construction, extends from a point just rearwardly of the forward edge of the top wall upwardly, rearwardly, and then downwardly and back towards the rear wall 10 where it is joined to the rear wall near the bottom edge thereof. The handle 16 may be mounted on the receptacle 4 by rivets, bolts, or other fastening elements. The ends of the handle 16 are formed to have flanges to facilitate the attachment of the handle to the receptacle.

FIG. 2 shows the use of an extension 18 to the handle 16. This extension is simply a bar or rod which is fastened at one end to an upper rear portion of the handle 16 to extend rearwardly thereof as shown. The forward end of the extension 18 is flattened to conform to the upper surface of the handle 16 to facilitate attachment thereto by way of rivets 19 or the like.

The scoop of the present invention also includes a door 20 attached at a rear edge by way of a hinge 22 to the forward edge of the top wall 11. The leaves of the hinge 22 are simply attached by rivets or other fasteners to corresponding contiguous edges of the door 20 and upper wall 11. The door 20 pivots or swings between an open position (shown in FIGS. 1 and 2), in which the door is pivoted upwardly and away from the opening 6, to a closed position (shown by dotted line 20 in FIG. 2), in which the door covers the opening 6. The door 20 is dimensioned so that when in the closed position, it fits within the side walls and bottom wall of the receptacle 4, as indicated by the dotted line 20*a* of FIG. 2. With this configuration, the door 20 may be used to push ashes or other debris through the opening 6 into the interior of the receptacle 4 as will be further discussed later on.

A coil spring 24 is attached at one end to the door 20 and at the other end to a forward portion of the handle 16 to bias the door normally to the open position. The spring 24 may be attached to the door handle by simply boring openings 25 and 26 in the door and handle respectively and then inserting the hooked ends of the coil spring 24 into the openings.

Figure 3:
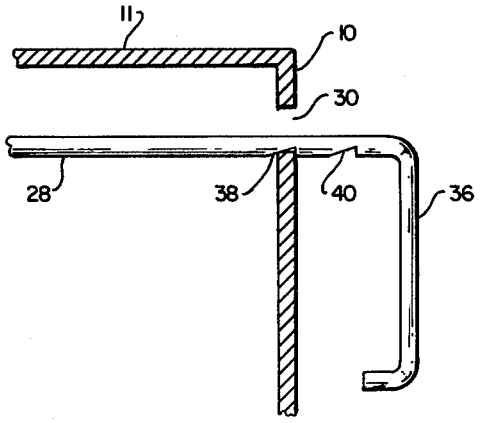
FIG. 3 shows a fragmented view of a portion of the pull rod of FIG. 2.

As best seen in FIG. 2, an elongate pull rod 28 is attached at one end to the underside of the door 20 and extends from the door through the receptacle 4 and out an opening 30 (FIG. 3) in the rear wall 10 of the receptacle. The forward end of the pull rod 28 is formed into an eyelet 32 which is coupled to an eyelet of a cotter pin 34. The legs of the cotter pin 34 are inserted through the opening 25 in the door 20 and then spread to secure the cotter pin in the door. The coupling of the eyelet 32 of the pull rod 28 to the eyelet of the cotter pin 34 allows the cotter pin to pivot relative to the pull rod. The rear end of the rod is formed into a downwardly turning gripping or grasping hook 36. As best seen in FIG. 3, a pair of notches 38 and 40 are formed at spaced-apart locations on the underneath side of the pull rod 28 to engage the lip of the opening 30 when the corresponding notch is positioned adjacent to the opening. The corresponding notch is caused to engage the lip of the opening 30 by simply moving the pull rod downwardly so that the notch in question contacts the lip.

In use, the handle 16 may be grasped at the rear thereof by one hand and pushed to move the receptacle 4 into contact with ashes or debris which the user desires to remove from a fireplace or the like. As the receptacle 4 is moved forwardly, ashes or debris will be pushed through the opening 6 into the interior of the receptacle. When it is desired to remove the receptacle from the fireplace or site of the ashes or debris, the user simply grasps the gripping hook 36, with the same hand being used to hold the handle 16, and pulls the pull rod 28 rearwardly. This causes the door 20 to pivot downwardly and into the opening 6 to further push ashes or debris to the interior of the receptacle 4 and to prevent ashes from sliding out of the receptacle. The pull rod 28 may then be moved downwardly so that the notch 38 engages the lip of the opening 30 to lock the door 20 in the closed position. With the door in the closed position, the receptacle 4 may be removed from the fireplace and the ashes or debris carried away. The door 20 is opened for discharge of the ashes or debris by simply raising the pull rod 28 upwardly to disengage the notch 38 from the lip of the opening 30, and then allowing the pull rod 28 to move forwardly by force of the biasing spring 24.

Provision of the handle 16 formed and attached to the receptacle 4 as shown in the drawings enables using the scoop with only one hand by a user. The rear portion of the handle 16 curves just behind the grasping hook 36 so that the same hand which is used to hold the handle 16 may also be used to grasp the hook 36 and pull it rearwardly. Because the handle 16 also extends over the top of the receptacle 4, the handle can be similarly grasped at an upper portion thereof for carrying the receptacle and contents again using only one hand.

Because the scoop may be used to clean hot ashes from a fireplace, the coil spring 24 is mounted exteriorily of the receptacle 4 so that such hot ashes will not be placed into contact with the spring. By so positioning the spring, the strength and tension of the spring is maintained for a longer period of time.

While the invention herein disclosed has been described by means of specific embodiments and applications thereof, numerous modifications and variations could be made thereto by those skilled in the art without departing from the spirit and scope of the present invention. It is therefore to be understood that within the scope of the appended claims, the invention may be practiced otherwise than as specifically described herein.

What is claimed is:

1. An ash and debris scoop comprising a receptacle having a generally flat bottom wall, side walls, a rear wall and top wall, said receptacle being open at one end, a door hingedly attached to the forward edge of the top wall for pivoting between a closed position, in which the door covers the opening in the receptacle, and an open position, in which the door is pivoted upwardly and away from the opening, means biasing the door normally to the open position, an elongate pull rod, one end of which is attached to the underside of the door, said rod extending from the door through the receptacle and through an opening in the rear wall thereof, the other end of the rod exterior to the receptacle including a hook-shaped grasping element for grasping by hand to enable pulling the rod rearwardly to thus pull the door to the closed position, said pull rod being formed with at least one notch therein to engage the lip of the opening in the rear wall when the rod is pulled rearwardly so that the door is in the closed position, to thereby prevent the rod from moving forwardly, and a handle which extends from a point generally near the forward edge of the top wall upwardly, rearwardly, and downwardly to a point on the rear wall below the grasping element, a rear portion of the handle being spaced behind the grasping element a distance to enable grasping and pulling the grasping element with one hand while holding the rear portion of the handle with said one hand.

2. A scoop as in claim 1 wherein said door is dimensioned to fit within the side walls and bottom wall of the receptacle when in the closed position.

3. A scoop as in claim 1 wherein the biasing means is located exteriorly of the receptacle.

4. A scoop as in claim 3 wherein the biasing means comprising a coil spring connected between the door and forward portion of the handle to normally bias the door to the open position.

5. A scoop as in claim 1 further including an elongate bar attached to the handle and extending rearwardly of the receptacle.

6. An ash and debris scoop comprising a housing having a generally flat bottom wall, side walls, a rear wall and a top wall, said housing being open at the front with the forward edge of the bottom wall projecting outwardly farther than the forward edge of the top wall, a door hingedly attached at a rear edge to the forward edge of the top wall for pivoting between a closed position, in which the door covers the opening in the housing, and an open position, in which the door is pivoted upwardly and away from the opening, means biasing the door normally to the open position, a handle which extends from the top wall upwardly, rearwardly, and downwardly to the rear wall, and an elongate pull rod, one end of which is attached to the underside of the door, said rod extending from the door through the housing to a location between the housing and the handle, the other end of said rod including a grasping element formed in the shape of a hook and positioned in front of the handle to enable grasping and pulling the grasping element while holding the handle with one hand.

7. A scoop as in claim 6 wherein said door is dimensioned to fit within the side walls and bottom wall of the housing, and to pivot over the forward edge of the bottom wall toward the rear wall.

* * * * *